United States Patent [19]

Harada

[11] 4,145,988

[45] Mar. 27, 1979

[54] EXHAUST SYSTEM FOR OUTBOARD MARINE PROPULSION UNIT

[75] Inventor: Norimichi Harada, Hamamatsu, Japan

[73] Assignee: Yamaha Hatsudoki Kabushiki Kaisha, Japan

[21] Appl. No.: 786,562

[22] Filed: Apr. 11, 1977

[30] Foreign Application Priority Data

Apr. 13, 1976 [JP] Japan ..... 51/46376

[51] Int. Cl.[2] ..... B63H 21/26

[52] U.S. Cl. ..... 115/73; 115/17

[58] Field of Search ..... 115/17, 18 R, 73

[56] References Cited

U.S. PATENT DOCUMENTS

| | | | |
|---|---|---|---|
| 3,045,423 | 7/1962 | Hulsebus | 115/17 |
| 3,310,022 | 3/1967 | Kollman | 115/17 |
| 3,577,952 | 5/1971 | Tado | 115/17 |
| 3,908,579 | 9/1975 | Miller et al. | 115/17 |
| 4,014,282 | 3/1977 | Kollman | 115/73 |

FOREIGN PATENT DOCUMENTS

| | | | |
|---|---|---|---|
| 2245932 | 9/1972 | Fed. Rep. of Germany | 115/73 |

*Primary Examiner*—Trygve M. Blix
*Assistant Examiner*—Sherman D. Basinger
*Attorney, Agent, or Firm*—Dennis P. Clarke

[57] ABSTRACT

Exhaust system for outboard marine propulsion unit including a hollow chamber formed in the housing of the unit and an engine exhaust pipe opening to the chamber. The exhaust pipe has a radially outwardly extending flange which divides the hollow chamber into two expansion compartments which are connected through a restricted passage, whereby the exhaust gas can be expelled through the two expansion compartments into air.

5 Claims, 6 Drawing Figures

EXHAUST SYSTEM FOR OUTBOARD MARINE PROPULSION UNIT

BACKGROUND OF THE INVENTION

The present invention relates to exhaust means and more particularly to muffled exhaust means for outboard marine engines.

Conventionally, outboard marine engines have exhaust passages which normally open into water so that engine exhaust gas is expelled into water. Further, in order to make exhausting of combustion gas possible under an idling or low speed engine operation wherein the exhaust gas pressure is insufficient to expel the exhaust gas into water, the outboard marine engines are additionally provided with auxiliary exhaust ports which open into air. Where the outboard marine engines are designed for use in lakes, ponds or the like, it may not be allowed to exhaust the engine combustion gas into water in order to avoid possible pollution of water by the engine exhaust gas.

Thus, outboard marine engines are always provided with exhaust passages which open into air so that they must also provided with means for attenuating exhaust noise. For the purpose, conventional outboard marine engines include a housing having an expansion chamber into which the engine exhaust pipe is projected. The housing is also formed with a radial partition wall which projects inwardly into the expansion chamber and encircle the exhaust pipe with a small clearance so as to divide the expansion chamber into two compartments which are connected together through a restricted flow passage defined by the clearance between the partition wall and the exhaust pipe. Thus, there is provided an exhaust passage wherein the exhaust gas from the exhaust pipe is first subjected to an expansion at the first expansion compartment, then forced to pass through the restricted flow passage and thereafter again allowed to expand at the second expansion compartment before it is exhausted.

In this known type of engine exhaust system, inconveniencies have been experienced in that the location of the partition wall cannot be arbitrarily determined owing to the configuration and manner of manufacture of the housing. In general, such a housing of an outboard marine engine has an appearance wherein the widthwise dimension is gradually decreased from the top and bottom ends toward the intermediate portion thereof with the smallest width at the intermediate portion. Since such a housing is usually formed by means of a casting technique, it has been very difficult to locate the aforementioned partition wall other than the portion where the widthwise dimension of the housing is the smallest because removal of casting cores may become very difficult. Further, due to the similar reasons, it has been very difficult to provide two or more axially spaced partition walls in the housing for the purpose of increasing the number of expansion compartments.

It is therefore an object of the present invention to provide exhaust means for an outboard marine engine wherein the aforementioned problems can be overcome.

Another object of the present invention is to provide exhaust means for an outboard marine engine which is easy to manufacture but provides for versatility of design.

A further object of the present invention is to provide novel exhaust means for an outboard marine engine which includes a plurality of expansion compartments for attenuating exhaust noise.

SUMMARY OF THE INVENTION

According to the present invention, the above and other objects can be accomplished by an outboard marine propulsion unit comprising an internal combustion engine unit having exhaust port means, housing means supporting said engine unit and adapted to be mounted on a body of a boat, propulsion means mounted on said housing and being driven by said engine unit through drive shaft means, said housing means being provided with hollow chamber means having outlet port means, engine exhaust pipe means having one end connected with said exhaust port means of the engine unit and being projected into said chamber means in the housing means, said exhaust pipe means being formed with at least one radially outwardly extending partition wall for dividing said hollow chamber means into at least two compartments which are connected together through restricted passage means.

According to the features of the present invention, the housing means has no projection extending into the hollow chamber means, so that no difficulty is encountered in casting the housing means. Further, a plurality of partition walls can be formed on the exhaust pipe means without any difficulty.

According to the present invention, the restricted passage means between the compartments may be formed by one or more clearances between the partition wall means and the inner wall surface of the housing means. Alternatively, such restricted passage means may be formed in the partition wall means.

The above and other objects and features of the present invention will become apparent from the following descriptions of a preferred embodiment taking reference to the accompanying drawings, in which:

DETAILED DESCRIPTION OF THE INVENTION

Figure 1:
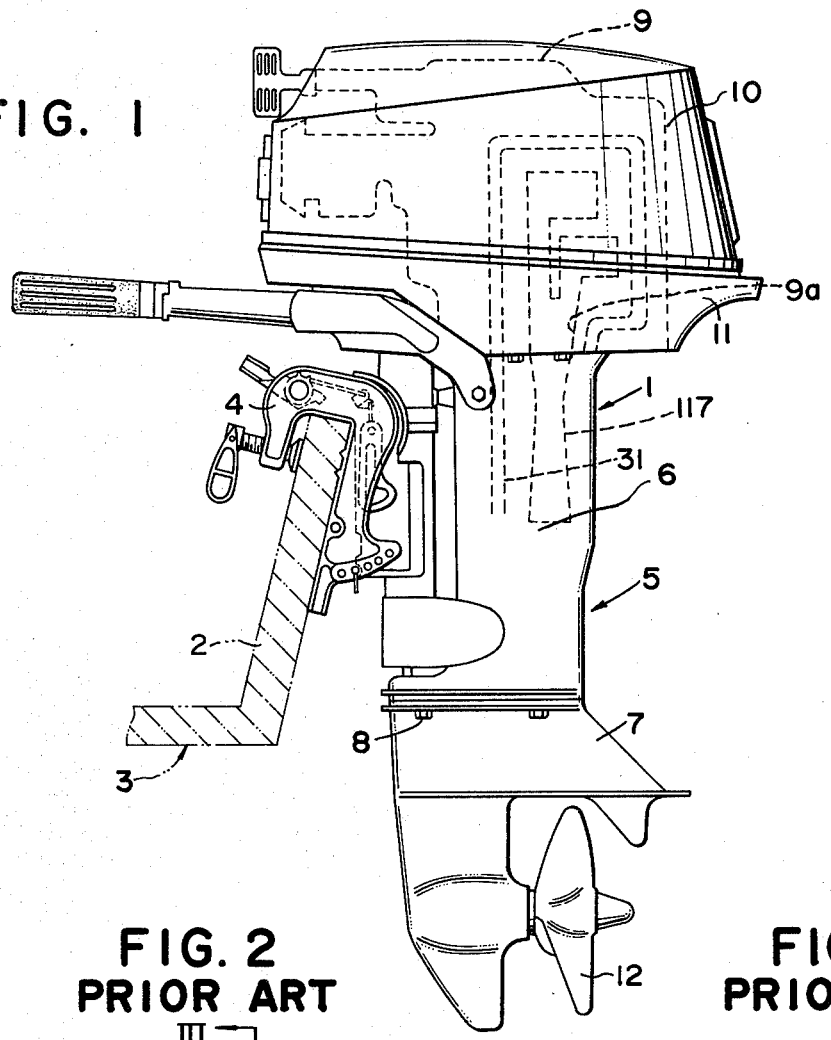
FIG. 1 is a side elevational view of an outboard marine propulsion unit to which the present invention can be applied.

Referring to the drawings, particularly to FIG. 1, the outboard marine propulsion unit 1 shown therein is mounted on the stern 2 of a boat hull 3 by means of a bracket 4. The propulsion unit 1 includes a housing assembly 5 which comprises an upper housing 6 and a lower housing 7 which are connected together by means of suitable number of bolts 8. An engine assembly 9 having an exhaust port *9a* is mounted on the housing assembly 5 and covered by an upper and a lower cowlings 10 and 11. The lower housing 7 carries a propeller 12 which is driven by the engine 9 through a drive shaft.

Figure 2:
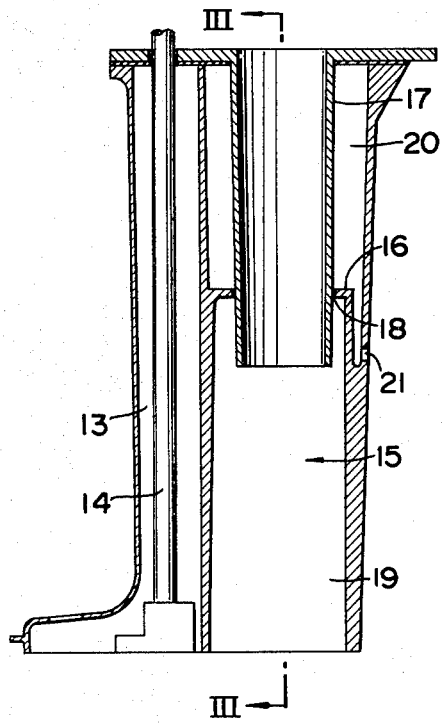
FIG. 2 PRIOR ART
FIG. 2 is a vertical sectional view of the upper housing employed in the propulsion unit of FIG. 1 and showing a typical example of prior art.
Figure 3:
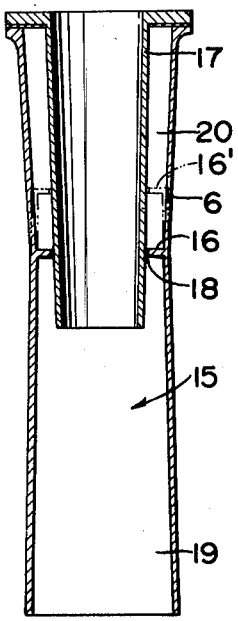
FIG. 3 PRIOR ART
FIG. 3 is a sectional view taken along the line III—III in FIG. 2.

Referring now to FIGS. 2 and 3, there is shown a typical example of the upper housing in accordance with a conventional design. The upper housing 6 includes a vertically extending cavity 13 through which the aforementioned propeller drive shaft 14 extends. The upper housing 6 further has a hollow chamber 15 and a radially inwardly extending flange or partition wall 16. An engine exhaust pipe 17 which is adapted to be connected with the engine exhaust port is disposed in the upper housing 6 so as to extend into the chamber 15 through the partition wall 16. The partition wall 16 thus encircles the exhaust pipe 17 with a slight clearance 18 so that the chamber 15 is divided into a first expansion compartment 19 and a second expansion compartment 20 which are connected together by a restricted passage which is defined by the clearance 18. The second expansion compartment is opened to the atmosphere through an outlet opening 21.

Referring to FIG. 3, it will be noted that the upper housing 6 has a widthwise dimension which gradually decrease from the upper and lower ends toward the intermediate portion. Since the upper housing 6 is manufactured by way of casting, the partition wall 16 must be located at a portion where the width of the housing 6 is the smallest in order to avoid difficulty in removing casting cores after casting operation. When it is desired to locate the partition wall 16 at a position as shown by the phantom line 16' in FIG. 3, it is necessary to increase the wall thickness of the housing 6 as shown and therefore disadvantages will be encountered in respect to weight. Further, such an increased wall thickness may cause blow holes in the housing wall.

Figure 4:
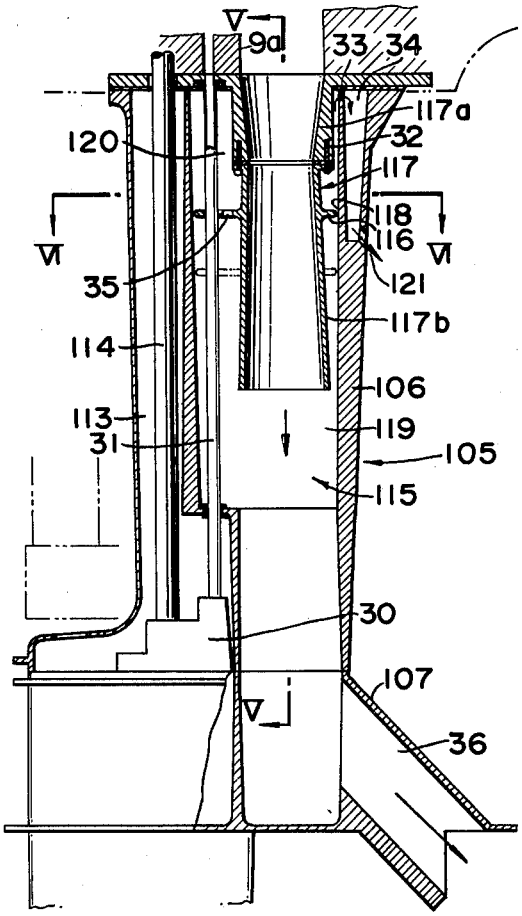
FIG. 4 is a sectional view similar to FIG. 2 but showing an embodiment of the present invention.
Figure 5:
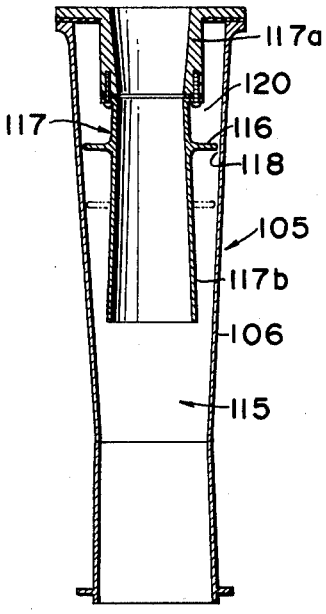
FIG. 5 is a sectional view taken along the line V—V in FIG. 4.
Figure 6:
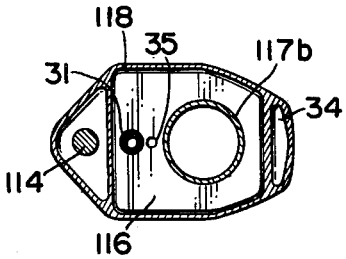
FIG. 6 is a cross-sectional view taken along the line VI—VI in FIG. 4.

Referring then to FIGS. 4 through 6, there is shown a housing assembly 105 which comprises an upper housing 106 and a lower housing 107. The upper housing 106 has a vertical cavity 113 through which a propeller drive shaft 114 is disposed. The drive shaft 114 transmits the engine output to the propeller 12 shown in FIG. 1. At the same time, the drive shaft 114 drives a water pump 30 which supplies engine cooling water through a conduit 31.

The housing 106 also has a hollow chamber 115 into which an engine exhaust pipe 117 extends. The engine exhaust pipe 117 comprises an upper block **117*a* and a pipe element 117*b* which are connected together by means of screws 32. The pipe element 117*b* is formed with a radially outwardly extending flange 116 which divides the chamber 115 into a first expansion compartment 119 and a second expansion compartment 120. A small clearance 118 is maintained between the flange 116 and the inner wall of the hollow chamber 115 to define a restricted passage between the first and second expansion compartments 119 and 120. The second expansion chamber 120 is connected through a small passage 33 with an outlet chamber 34 which opens to the atmosphere through an outlet port 121. The flange 116 is formed with a cooling water drain hole 35**.

The first expansion compartment 119 is connected at its lower end with a main exhaust passage 36 which normally opens into water under a normal operating condition. Thus, when the engine is operated at a medium or high speed, the engine exhaust gas is expelled under the exhaust pressure into water. Under a low speed or idling operation of the engine wherein the exhaust pressure is not adequately high to expel the engine combustion gas into water, the gas is exhausted from the first expansion compartment 119 through the restricted passage 118 into the second expansion compartment 120 and then through the passage 33, the outlet chamber 34 and the outlet port 121 to the atmosphere. Through the course of the exhausting, the engine exhaust noise is adequately attenuated due to repetition of expansion.

According to the present invention, a plurality of interconnected expansion compartments are defined by a flange or partition wall which is integrally formed on the exhaust pipe. Therefore, it is unnecessary to provide any inward projection in the hollow chamber of the housing, so that any difficulty will not be encountered in manufacturing and designing the housing. The partition wall on the exhaust pipe can be located at any desired position without causing any manufacturing difficulty. Further, it is possible to provide two or more partition walls to define an increased number of expansion compartments. If desired, the exhaust pipe may be divided into a plurality of elements to facilitate manufacturing operation.

The restricted passage between the expansion compartments may not necessarily be provided by the clearance between the partition wall and the inner wall surface of the hollow chamber in the housing but the partition wall may be formed with one or more apertures to form such a restricted passage.

The invention has thus been shown and described with reference to a specific embodiment, however, it should be noted that the invention is in no way limited to the details of the illustrated structures, but changes and modifications may be made without departing from the scope of the appended claims. For example, the present invention can also be applied to a propulsion unit wherein all engine combustion gas is exhausted into air.

I claim:

1. Outboard marine propulsion unit comprising an internal combustion engine unit having exhaust port means, housing means supporting said engine unit and adapted to be mounted on a body of a boat, propulsion means mounted on said housing and being driven by said engine unit through drive shaft means, said housing means having a top end and an inner wall surface defining hollow chamber means extending downwardly from the said top end of the housing means and having outlet port means, engine exhaust pipe means having one end connected with said exhaust port means of the engine unit and being projected into said chamber means in the housing means, said exhaust pipe means being formed with at least one radially outwardly extending partition wall for dividing said hollow chamber means into at least two compartments which are connected together through restricted passage means defined by the clearance between said outwardly extending partition wall and said inner wall surface, whereby engine exhaust gas is directed from the exhaust pipe means through one of the compartments, the restricted passage means and the other of the compartments to the outlet port means.

2. Outboard marine propulsion unit in accordance with claim 1 in which said exhaust pipe means is opened to one of the compartments and the other of the compartments is opened to atmosphere through said outlet port means.

3. Outboard marine propulsion unit in accordance with claim 1 in which said exhaust pipe means is opened to one of said compartments and the other of said compartments is opened to atmosphere through an outlet chamber and said outlet port means.

4. Outboard marine propulsion unit in accordance with claim 3 in which said one compartment is connected with main exhaust passage means which opens under normal conditions into the water.

5. Outboard marine propulsion unit in accordance with claim 1 in which said engine exhaust pipe means is connected with engine block means in said engine unit.

* * * * *